United States Patent [19]

Meese

[11] 3,958,469

[45] May 25, 1976

[54] TORQUE WRENCH

[75] Inventor: John W. Meese, Avon, Ohio

[73] Assignee: Emerson Electric Co., St. Louis, Mo.

[22] Filed: Oct. 14, 1975

[21] Appl. No.: 621,739

[52] U.S. Cl. ..... 81/58.3; 81/58.4

[51] Int. Cl.[2] ..... B25B 13/00

[58] Field of Search ..... 81/52.4 R, 58, 58.1, 81/58.3, 58.4, 60

[56] References Cited

UNITED STATES PATENTS

| | | | |
|---|---|---|---|
| 2,601,799 | 7/1952 | Garwood | 81/52.4 R |
| 2,697,370 | 12/1954 | Brooks | 81/58.3 X |
| 3,099,177 | 7/1963 | Kostka | 81/58.1 X |
| 3,651,718 | 3/1972 | Thomasian | 81/52.4 R |

*Primary Examiner*—James L. Jones, Jr

[57] ABSTRACT

In a ratcheting torque wrench of the I-type in which an axially movable locking cup is mounted on and around a shaft and an end of a housing from which the shaft extends and in which the shaft is mounted for rotation and limited axial movement. The shaft having stubs projecting diametrically from it, stop members are provided on an outer face of the locking cup to engage the stubs when the locking cup and shaft are moved apart axially to a place at which the stubs clear the cup and the shaft is rotated relative to the cup in the ratcheting direction.

3 Claims, 10 Drawing Figures

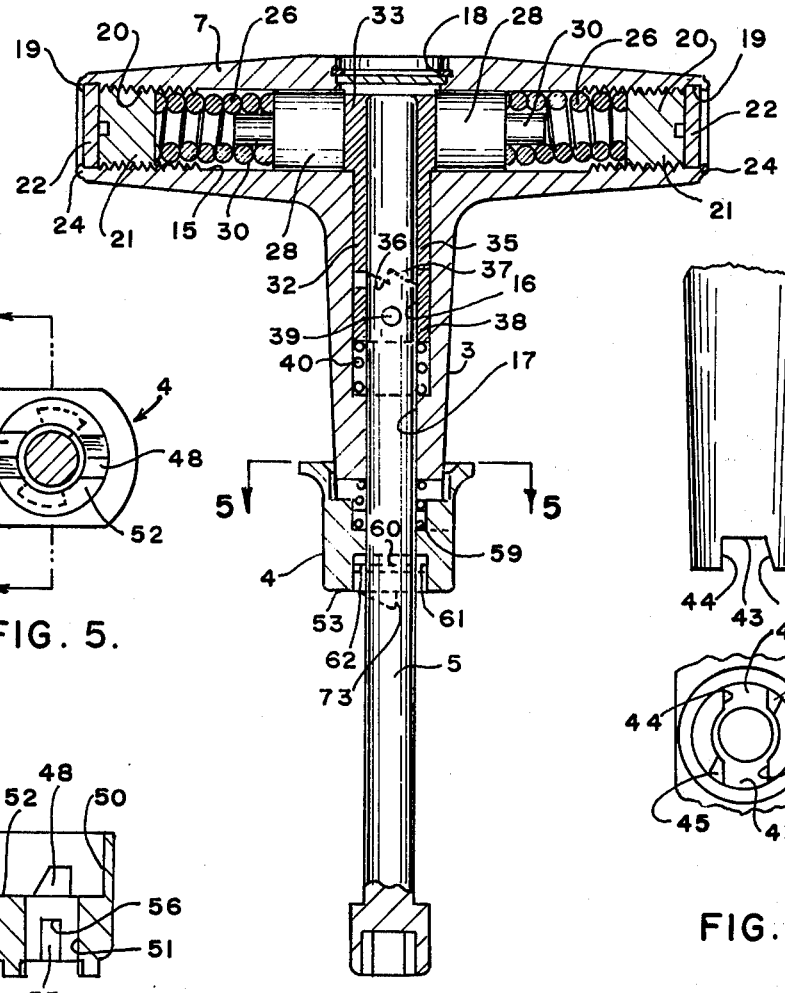
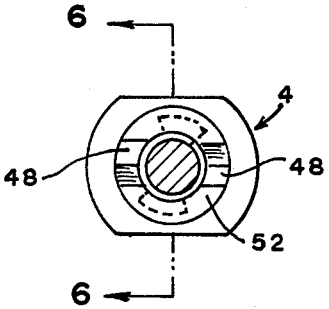
FIG. 5.
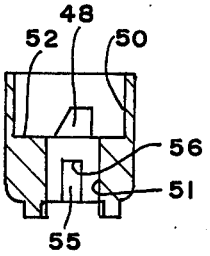
FIG. 6.
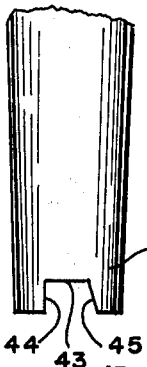
FIG. 7.
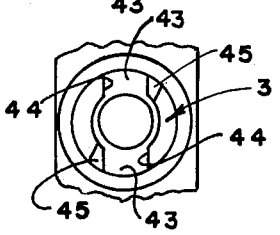
FIG. 8.
FIG. 4.
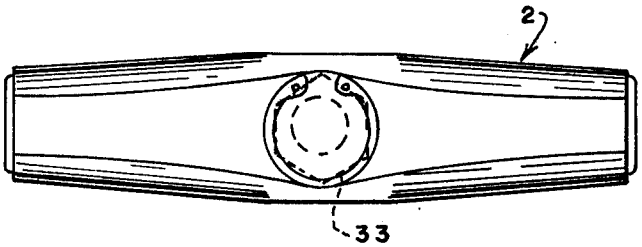
FIG. 9.
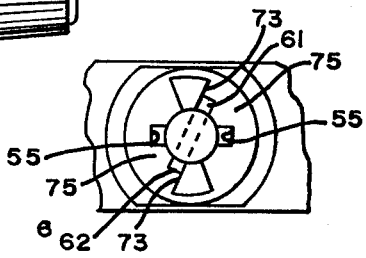
FIG. 10.

TORQUE WRENCH

BACKGROUND OF THE INVENTION

In a conventional T-shaped torque wrench of the type used for tightening coupling sleeves for cast iron soil pipe and the like, the shaft of the wrench is arranged to be turned in the tightening direction until the screw or nut being tightened reaches the predetermined desired tightness, as for example 60 inch. lbs. of torque, when the handle of the wrench will begin to turn relative to the shaft.

In conventional wrenches, the shaft is arranged to ratchet in the opposite direction unless the locking or reversing collar is pulled against the bias of the spring toward the handle, when lugs on the locking collar engage notches in the stem of the handle, which locks the collar against rotation, and a pin with ends projecting from the shaft, riding in channels in the locking cup, locks the shaft against rotation, permitting the shaft to be turned in the reverse direction.

The problem with the conventional arrangement is that it is difficult to hold the locking cup in its retracted position and turn the wrench at the same time. This has been a well-known problem and a source of great annoyance as long as such wrenches have been used.

One of the objects of this invention is to provide in an otherwise conventional T-shaped torque wrench a simple, effective means for locking the shaft against ratcheting, which means permit the shaft to be locked without requiring that the locking cup be held manually in its retracted position.

Other objects will become apparent to those skilled in the art in the light of the following description and accompanying drawings.

SUMMARY OF THE INVENTION

In accordance with this invention, generally stated, in a conventional T-shaped torque wrench such as is sold by the Ridge Tool Company as its No. 902 Torque Wrench, wherein a locking cup is spring biased away from the stem of a housing, and a shaft is spring biased in a direction toward the housing in such a way as to permit limited axial movement against the bias of that spring in the opposite direction, the locking cup having a radial face and channels opening through the radial face, stop members are provided on the radial face of the locking cup at a point offset from the channels, so as to provide between the channels and the stop member a bearing surface upon which the projecting ends of a pin through the shaft of the wrench can rest when the ends of the pin engage an axial face of the stop members. The shaft is biased axially toward the housing by a spring which is stronger than the spring which biases the locking cup away from the housing, so that the shaft spring overcomes the bias of the cup spring and holds the cup in its locking position. The stop members are so arranged as to drive the shaft in the direction in which the shaft would normally ratchet, when the handle is rotated in that direction.

In the preferred embodiment, the stop members take the form of wedges or inclined planes, so that if the projecting ends of the pin are on the wrong side of the stop member, they will simply ride up on and over the stop members and snap into place. In any event, when the handle is rotated in its torquing direction, the ends of the pin will automatically snap into the channels when the shaft is held against free rotation by a screw head or the like, thus ensuring against accidental overtorquing.

DESCRIPTION OF THE DRAWINGS

In the drawings,

FIG. 4 is a sectional view, partly broken away, of the device of FIG. 1, but with the shaft in normal torquing position;

FIG. 5 is a sectional view taken along the line 5—5 of FIG. 4;

FIG. 6 is a sectional view of a locking cup taken along the line 6—6 of FIG. 5;

FIG. 7 is a fragmentary view in side elevation of an outer portion of the stem of a housing of the device shown in FIG. 1;

FIG. 8 is a fragmentary view in end elevation of the housing shown in FIG. 7;

FIG. 9 is a view in end elevation, viewed from left to right of FIG. 1, of the device shown in FIG. 1; and FIG. 10 is a sectional view taken along the line 10—10 of FIG. 3.

DESCRIPTION OF THE PREFERRED EMBODIMENT

Figure 1:
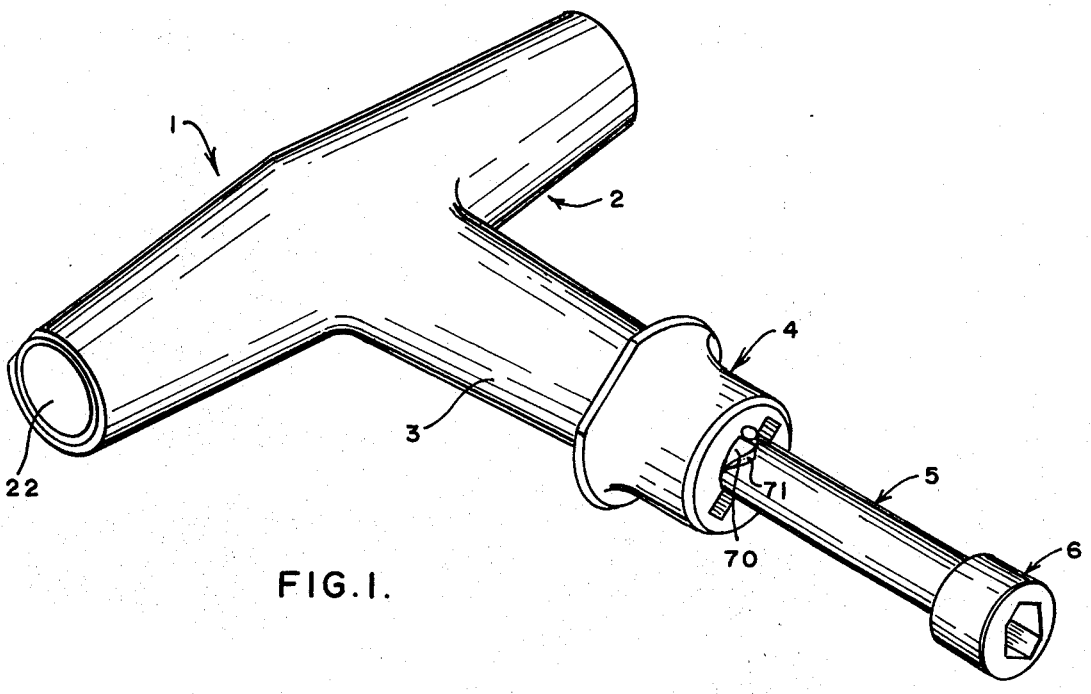
FIG. 1 is a view in perspective of one embodiment of torque wrench of this invention in "countertorquing" condition.
Figure 2:
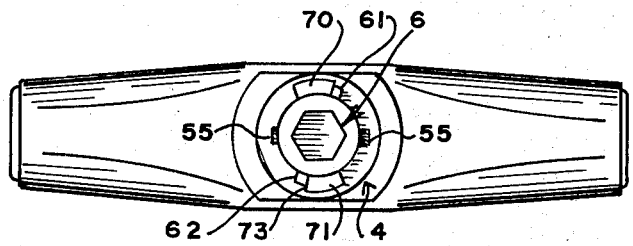
FIG. 2 is a view in end elevation, viewed from right to left in FIG. 1, of the device shown in FIG. 1.
Figure 3:
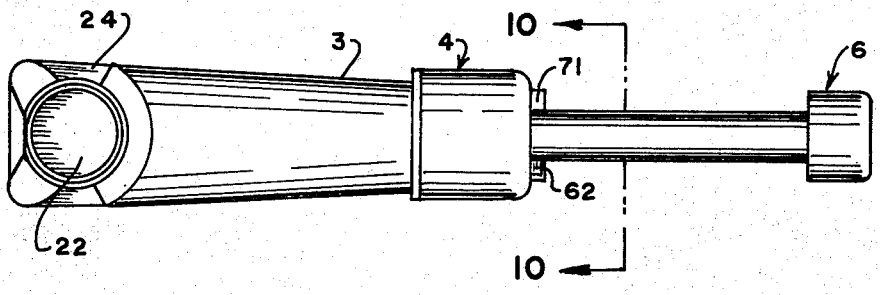
FIG. 3 is a view in side elevation of the device shown in FIG. 1.

Referring now to the drawings for one illustrative embodiment of torque wrench of this invention, reference numeral 1 indicates an assembled T-shaped torque wrench, which includes a handle 2 with a stem 3, a locking cup 4, a shaft 5 and a socket 6. The socket 6 is conventional, but the shaft 5 can carry any type of tool appropriate to use with a torque wrench of this type.

Referring now particularly to FIG. 4, the handle 2 has a cross member 7 through which a cross passage 15 extends. The cross passage 15 is intersected at its center by an axial passage 16 extending through the stem 3. The axial passage 16 has a counterbored and stepped section 18 at its one end, and a bore 17 of reduced diameter at its other end within which the shaft 5 is journaled.

As seen in FIGS. 4 and 9, the axial passage 16 is closed at its counterbored end by means of a closure disc and C-ring.

The cross passage 15 has a counterbored and stepped section 19 at each end, and internally threaded portions 20 inboard of the counterbores 19, within which externally threaded adjusting plugs 21 are mounted. The ends of the passage 15 are closed by closure disc 22, seated against the step, and staked into place by means of staked or rolled edges 24.

Heavy helical torque springs 26 are mounted with one of their ends against the inner radial faces of the adjusting plugs 21, and with their other ends bearing against radial faces of torque plugs 28. The torque plugs 28 have integral stems 30 which serve to center the torque springs 26, which are compressed to the desired degree of compression between the adjusting plugs 21 and the torque plugs 28.

A torque sleeve 32 has a hexagonal boss 33, with flats against which inboard faces of torque plugs 28 normally bear. The boss 33 is integral with a cylindrical barrel 35, and of a greater diameter than the barrel. The barrel 35 is journaled in a part of the axial passage 16. The barrel 35 terminates at its outer end in serrations or teeth 36, which are complementary to teeth 37 on a shaft collar 38, pinned to the shaft 5 by means of a collar pin 39.

As can be seen in FIG. 4, the shaft 5 extends entirely through the barrel 35 and boss 33. It is slidably and rotatably journaled within the torque sleeve 32 and bore 17.

The shaft 5 is biased toward the torque sleeve 32 by a helical shaft spring 40, caged between a shoulder formed between the bore 17 and the part of the axial passage 16 of greater diameter, at one end, and a radial surface of the shaft collar 38 at its other end. The shaft spring 40 biases the teeth 37 into full meshing engagement with the teeth 36 when the wrench is rotated in the direction in which the shaft is intended to be torqued, but is arranged to permit sufficient axial travel of the shaft to allow the teeth 37 and 36 to clear one another, to ratchet, when the handle is turned in the opposite direction while the shaft 5 is held against rotation.

The stem 3 has, in its outer end, a pair of notches 43, each with an axial face 44 and a slanted or camming face 45.

The locking cup 4 has a stepped bore, with a section 50 of an inside diameter large enough slidably to receive the end of the stem 3, and a section 51 of a smaller inside diameter, to fit closely but slidably on the shaft 5. Between the bore sections 50 and 51 is a radial shelf 52. A pair of lugs 48, shaped complementarily to the notches 43, extend from the wall defining the bore 50 radially part way through the radial extent of the shelf 52, leaving a ledge, as shown particularly in FIG. 4. Within the bore section 51, 180° apart, are two dead-ended axial channels 55 one end of which extends through an outer radial face 53 of the cup 4. The channels terminate in an inner end wall 56.

The cup 4 is biased in a direction away from the end of the stem 3 to a position at which the lugs 48 clear the notches 43, by a helical locking cup spring 59 which is much weaker than the shaft spring 40. The spring 59 bears at one end on the locking cup ledge and at the other, on a radial face of the stem. The movement of the locking cup 4 away from the stem 3 is limited by the bearing of stubs 61 and 62, which constitute the projecting ends of a shaft pin 60 tightly mounted in a passage extending diametrically through the shaft 5 on the inner end wall 56.

The locking cup spring 59 is so arranged as to permit the lugs 48 fully to seat within the notches 43, at which position, the shaft pin 60 and its stubs 61 and 62 remain within the channels 55 while the teeth 36 and 37 are meshed.

All of the device described above is conventional.

In the illustrative embodiment of wrench shown, stop members 70, in the form of wedges each with an axial face 73 and an inclined surface 71, are made integral with the radial face 53 of the locking cup 4. The stop members 70 in the embodiment shown are 180° apart, with their centers approximately 90° from the centers of the channels 55 and with their axial faces 73 offset sufficiently from the channels 55 to provide a bearing surface 75 on the radial face 53 of sufficient extent to accommodate the stubs 61 and 62.

The wrench is assembled in the conventional way.

In use, in the torquing condition, the wrench is used and acts in the conventional way. However, when it is desired to loosen a screw or otherwise operate the wrench in what is normally the ratcheting direction, the cup 4 is retracted against the bias of the spring 59 to seat the lugs 48 within the notches 43, the shaft 5 is then pulled away from the end of the cup 4, against the bias of the shaft spring 40, until the stubs 61 and 62 clear the channels 55, and the shaft is then rotated in the direction to bring the stubs 61 and 62 against the axial faces 73 of the stop members 70. The stem is then released, whereupon the shaft spring 40, overriding the cup spring 59 and acting through the shaft and stubs which bear upon the bearing surfaces 75 on the radial face 53, holds the cup in its fully retracted position.

When the handle is now rotated in its counter-torquing direction, the force applied to the handle is transmitted by way of the notch faces 44, cup lugs 48, the faces 73 of the stop members 70, and the stubs 61 and 62, to the shaft 5.

To restore the wrench to its torquing condition, the shaft can be turned manually in the torquing direction relative to the handle, until the stubs 61 and 62 slide into the channels 55, which permits the shaft to move into the stem 3 and the cup 4 to move to clear the lugs 48 from the notches 43. The same thing will happen if the wrench is not restored, when a screw is to be torqued, even if the stubs for some reason reach a position on the edge of the stop members opposite the axial faces 73, in which case the stub will ride up over and beyond the inclined surface 71 and drop into the channels 55.

If the stubs were accidently bent or the channels obstructed, so that the wrench were not restored to proper torquing condition, the wrench would still not permit overtorquing, but instead would signal that something is wrong by clicking every 180° as the stubs ride over the stop members, and providing little if any tightening.

Numerous variations in the construction of the wrench of this invention within the scope of the appended claims, will be apparent to those skilled in the art in the light of the foregoing disclosure.

Merely by way of illustration, one or more axially extending pins or square lugs can be substituted for the wedge shaped stop members. However, the pins are capable of being used to by-pass or override the torque-limiting mechanism, which is undesirable in all but special applications. One shaft projection can be used instead of two. These variations are merely illustrative.

Having thus described the invention, what is claimed and desired to be secured by Letters Patent is:

1. In a torque wrench of the type in which a shaft carrying ratchet teeth is axially aligned with and biased by a shaft spring toward a torque sleeve with complementary ratchet teeth, both said shaft and sleeve being mounted in a housing, said wrench shaft being supported in said housing for axial movement against the bias of the spring to permit said teeth to clear when the wrench is rotated in one direction, said wrench having a locking cup mounted on an end of said housing, said locking cup being spring biased toward a free end of said wrench shaft by a spring weaker than said shaft spring, said cup being mounted around said shaft and for axial movement with respect to said housing and shaft and having means cooperating with said housing when in an axial position close to said housing for restraining said locking cup against rotation relative to said housing and when in an axial position more remote from said housing, releasing said cup for rotation relative to said housing, said locking cup having an outer radial surface remote from said housing and a channel extending axially through said surface and adjacent said shaft, and said shaft having a substantially radially directed projection normally axially slidably seated in said channel, the improvement comprising said projection being positioned axially relative to the locking cup at a place at which when said locking cup is in said axial position close to said housing and the said shaft is moved axially in a direction to clear the ratchet teeth the said projection clears the outer radial surface of said locking cup, and a stop member having a stop face extending substantially axially from said radial surface at a place offset from said channel, said stop face being offset from said channel sufficiently to provide between said stop face and said channel a supporting area on said radial surface to support said shaft projection against axial movement toward said housing when said projection bears against said supporting area, and projecting axially sufficiently to engage positively the said shaft projection and prevent rotation of the said shaft relative to said housing in one direction.

2. The improvement of claim 1 wherein the said stop member is wedge shaped, with an inclined surface extending from said stop face toward said radial surface.

3. The improvement of claim 1 wherein two projections are provided and two correspondingly located stop members.

* * * * *